US005810987A

United States Patent [19]

Opitz

[11] Patent Number: 5,810,987

[45] Date of Patent: Sep. 22, 1998

[54] PROCESS FOR EFFICIENTLY ELECTROPHORETICALLY COATING SMALL ITEMS

[75] Inventor: Christian Opitz, Starnberg, Germany

[73] Assignee: SEP Gesellschaft fur technische Studien Entwicklung Planung mbH, Munchen, Germany

[21] Appl. No.: 777,279

[22] Filed: Dec. 27, 1996

Related U.S. Application Data

[63] Continuation of Ser. No. 537,291, Sep. 29, 1995, abandoned, which is a continuation of Ser. No. 376,074, Jan. 20, 1995, abandoned, which is a continuation of Ser. No. 212,682, Mar. 11, 1994, abandoned, which is a continuation of Ser. No. 071,335, Jun. 1, 1993, abandoned, which is a continuation of Ser. No. 851,228, Mar. 12, 1992, abandoned, which is a continuation of Ser. No. 454,508, Dec. 21, 1989, abandoned.

[30] Foreign Application Priority Data

Dec. 23, 1988 [DE] Germany ..... 38 43 544.6

[51] Int. Cl.[6] ..... C25D 13/12

[52] U.S. Cl. ..... 204/512; 204/507; 204/623; 204/624

[58] Field of Search ..... 204/180.2, 201, 204/202, 203, 299 EC, 300 EC

[56] References Cited

U.S. PATENT DOCUMENTS

| | | | |
|---|---|---|---|
| 3,539,489 | 11/1970 | Ness | 204/180.2 |
| 3,616,392 | 10/1971 | Haney | 204/181.1 |
| 3,682,136 | 8/1972 | Haney et al. | 118/620 |
| 3,728,247 | 4/1973 | Haney | 204/181 |
| 3,830,716 | 8/1974 | Haney et al. | 204/180.2 |
| 3,879,277 | 4/1975 | Guzzetta et al. | 204/181 |
| 3,898,151 | 8/1975 | Nessar | 204/201 |
| 3,923,623 | 12/1975 | Brown | 204/180.2 |
| 3,945,901 | 3/1976 | Nessar | 204/181 |
| 4,039,415 | 8/1977 | Shibayama et al. | 204/180.2 |
| 4,196,023 | 4/1980 | Rowe | 204/180.2 |
| 4,817,650 | 4/1989 | Tilton | 204/202 |

*Primary Examiner*—Kathryn L. Gorgos
*Assistant Examiner*—Kishor Mayekar
*Attorney, Agent, or Firm*—Schweitzer Cornman Gross & Bondell LLP

[57] ABSTRACT

A method for the electrophoretic dip coating of small parts and bulk goods having an electrically conducting surface wherein the items to be coated are placed in a single layer onto a support which may be electrically conducting or nonconducting. During immersion, the surface contact locations are changed between the items to be coated themselves and the surface contact locations between the items and the support.

8 Claims, 4 Drawing Sheets

PROCESS FOR EFFICIENTLY ELECTROPHORETICALLY COATING SMALL ITEMS

This is a continuing application of U.S. Ser. No. 08/537,291, filed Sep. 29, 1995, which was a continuation of U.S. Ser. No. 08/376,074, filed Jan. 20, 1995, which was a continuation of U.S. Ser. No. 08/212,682, filed Mar. 11, 1994, which was a continuation of U.S. Ser. No. 08/071,335, filed Jun. 1, 1993, which was a continuation of U.S. Ser. No. 07/851,228, filed Mar. 12, 1992, which was a continuing application of U.S. Ser. No. 07/454,508, filed on Dec. 21, 1989, all now abandoned.

FIELD OF THE INVENTION

The present invention relates to a method for the electrophoretic anodic and preferably cathodic dip coating of small parts with an electrically conducting surface, which can be wetted by the paint, such as small metal parts, as well as small parts of non-metals, especially small metallized parts of ceramic or thermostable organic polymer materials, with water-dilutable paints, especially with water-based paints, and an apparatus for implementing the method.

BACKGROUND OF THE INVENTION

Electrophoretic dip coating (anaphoresis, cataphoresis) is state of the art for suspended or rack parts, such as the cataphoretic coating of mass-produced body parts in the automobile industry. The part is cleaned (degreased, scoured), provided with a layer to improve corrosion protection or adhesion (for example, by phosphatizing followed by immersion in dilute chromic acid) and electrophoretically dip coated, all on the same rack.

In the case of small parts (bulk goods), on the other hand, suspending them on racks is either not possible at all, or economically disadvantageous.

For electrophoretic dip coating, the products to be coated must be brought to the same electrical potential of the corresponding electrode. At the contact points between this electrode and the products, no paint is deposited. If the products are suspended on racks, contact between the rack, which functions as the electrode, and the products is displaced into regions, where areas, which have not been coated, are acceptable.

In the case of small parts or bulk goods, such as bolts, nuts, hinges, mountings, localization of the contact points is nonsensical for economic reasons, and the contact points are generally distributed at random over large areas of the surface of the small parts. An incomplete coating of the surfaces of the small parts therefore results.

Electrophoretic dip coating of small parts is disclosed in Belgian Patent 695,619. There, small parts are passed through an electrodip bath with a conveyor belt. The conveyor belt has cams and hooks, which are supposed to improve the mechanical contact between the small parts and the conveyor belt. Furthermore, in U.S. Pat. No. 3,616,392, the electrophoretic dip coating of small parts is disclosed, these small parts being conveyed on a first conveyor belt within an electrodip bath and, by this belt, onto a second conveyor belt within the dip bath. By these means, adhering gas bubbles are removed. The German Federal Republic published patent application No. 22 32 162 discloses the electrophoretic dip coating of small parts on a conveying device, which passes through an electrodip bath. In accordance with this method, it is ensured that the small parts cannot move on the conveyor belt during the coating process. By means of this state of the art, the disadvantage of the insufficient coating of the surfaces of small parts is not eliminated. Furthermore, there are difficulties with continuous operation.

DESCRIPTION OF THE INVENTION

Figure 1:
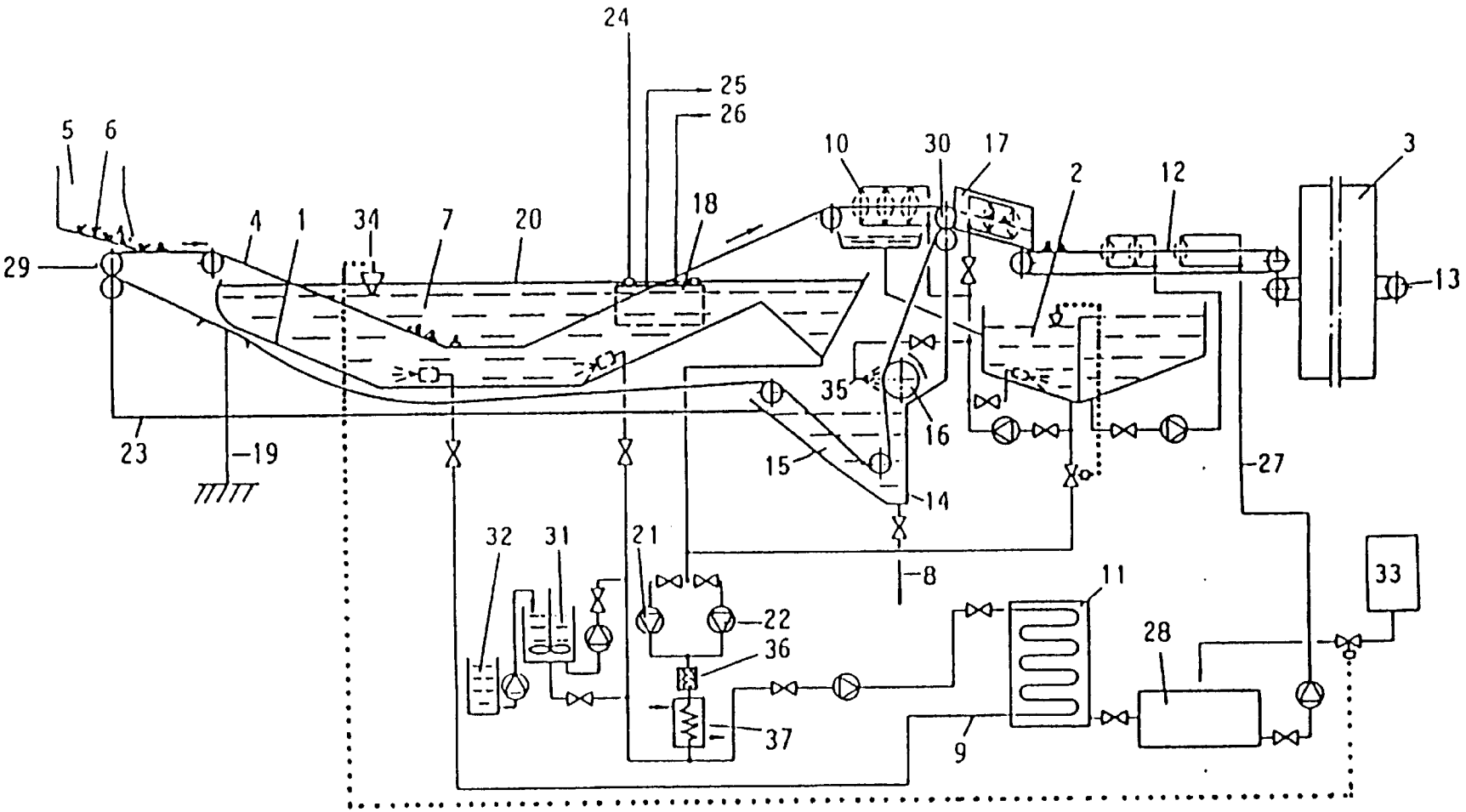
FIG. 1 is a schematic flow scheme showing the process of the invention.

It is an object of the invention to provide a continous coating of small parts or bulk goods by an electrophoretic method. In this way, good corrosion protection is to be achieved.

Within the scope of the invention, it has been ascertained that this objective can be accomplished by changing the position of the small parts or bulk goods to be coated on their support in the electrodip bath. After such a change in position, the previous contact points between the small parts and their support, or between the small parts relative to one another and/or contact electrodes, are accessible to coating. With knowledge of the state of the art, which avoids a shift, it was not to be expected that electrical contact through the insulating paint layer would be sufficient to allow a coating of the original contact points, which are exposed after the change in position and are not yet coated.

The invention therefore relates to a method for electrophoretic dip coating of small parts and bulk goods with an electrically conductive surface by immersion in an aqueous dip bath, electrophoretic paint deposition, removal from the dip bath, rinsing and baking of the paint coating deposited, which is characterized by the fact that a) either the small parts to be coated or the bulk goods to be coated are placed on a support with high electrical conductivity, which can be connected as an electrode, and are dipped into the electrodip bath together with this support and, again after the deposition, are removed once more together with this support, the support being provided with an electrically insulating layer except in the areas required for the connection as an electrode and for contacting with the small parts or bulk goods, and the contact surfaces between the small parts or the bulk goods to be coated and the support, which is connected as an electrode, as well as possible contacting surfaces between the small parts or within the bulk goods being changed at least once in the electrodip bath, or b) the small parts to be coated or the bulk goods to be coated are placed on a support, which is not an electrical conductor, and are dipped into the electrodip bath together with this support, and are removed after the deposition once more together with this support, a contacting of the small parts or of the bulk goods taking place in the electrodip bath by means of an electrode being placed against the small parts or bulk goods from above, and being removed again, at the latest, before the baking, whereby at least those parts of the electrode that are immersed into the lacquer bath, except its surfaces that are required to contact the small parts or the bulk goods, are covered with an electrically insulating coating and whereby the contact surfaces between the small parts or the bulk goods to be coated, the support, and the electrode, as well as possible contact surfaces between the small parts or within the bulk goods being changed at least once in the electrodip bath.

If the various bath parameters (voltage, temperature, etc.) are adjusted appropriately for the paint and the products, a paint layer can be deposited on the small parts in the dip bath in such a manner, that this layer already adheres so firmly to the surface before the baking, that normal frictional contacts, for example, between the parts, results in almost no damage to the coating. Furthermore, these electrocoagulated paint layers have a sufficient electrical conductivity between the newly created contact surfaces that result after a change in position of the products, that further paint deposition, particularly on the previous contact areas, becomes possible.

For the inventive method, a single layer of the small parts is preferred. By these means, good electrical contact between the individual small parts and their support, which is used, for example, as the electrode, is ensured, indirect contacts over one or more small parts are avoided and sites, which are inaccessible to a coating process because small parts are lying on top of one another, are avoided. The single layer of small parts during the rinsing process facilitates effective removal of excess paint and prevents the adhesion of the small parts in the baking oven.

It is possible to spray the small parts to be coated before they are immersed in the bath for electrophoretic dip coating or to wet them by immersing them in a prior paint bath. The paint used is the same as that used for the electrophoretic dip coating, the paint and the small parts having the same electrical potential. By these means, the uniformity of the coating is improved in the event that goods with dry surfaces are to be coated.

Pursuant to a preferred embodiment, the small parts to be coated are transported on a conveyor belt as support through the electrodip bath.

For this, an electrically conducting conveyor belt can be used, which is provided with an insulating layer except in the areas required for connection as an electrode and for contacting the small parts. This conveyor belt is used as the electrode. However, paint is also deposited on such a conveyor belt. In such a case, the conveyor belt should not be passed into the baking oven along with the coated small parts, since the baked paint can then be removed again only with great difficulty and effort.

Preferably, the conveyor belt is grounded. This means that only to the bath liquid in the bath for electrophoretic dip coating is under a voltage. The required safety measures can be achieved with much less effort in this case than if voltage were to be applied to the conveyor belt.

A conveyor belt with an electrically non-conducting surface can be passed through the electrodip bath and then through the subsequent rinsing device and through the baking oven with the small parts lying on it, provided that the conveyor belt is thermally stable at the temperatures required for the baking process.

The belt speed is one parameter for adjusting the coating thickness. Fine-tuning of the throughput of such a continuous coating system is possible by way of the belt velocity. The magnitude of the throughput can be established by way of the width of the conveyor belt.

By selecting or adjusting the entry and emergence angles of the conveyor belt into and out of the electrodip bath, the small parts and bulk goods on the conveyor belt can generally be prevented from sliding.

For small parts that roll, particularly those workpieces with a rotationally symmetric geometry or in the case of steep entry and emergence angles of the coating belt, a conveyor belt with cams is preferred.

By means of stationary or mobile belt guiding devices, the conveyor belt in the coating bath is forced to change the transporting direction at certain sites or for a short time, so that the small parts on the conveyor belt are rearranged and the uncoated contact surfaces between the products and the belt are changed. The change in contact surfaces can also be brought about by shifting parts of a segmented conveyor belt relative to one another or by intermittent jarring.

Paint is carried out of the dip bath by the conveyor belt. Before it is baked, this paint can easily be removed again. The uncoagulated paint portion can easily be removed by simple rinsing. On the other hand, it is advantageous to remove the paint electrocoagulated on the metallic surfaces in 2 stages with one or more rotating or stationary brushes and to redissolve the paint in the rinse water coming from the rinsing device.

In order to prevent the remaining paint solids, which adhere to the conveyor belt, drying out on the way to the charging station, so that an adhering, thicker layers of paint can build up on the conveyor belt during prolonged operations, the conveyor belt, during its return to the charging station, can be passed through a tunnel saturated with paint solvent vapor.

If the inventive method is not to be carried out continuously, the small parts that are to be coated can be immersed in the electrodip coating bath on trays or swivel drums, which form the support in each case. The angle, through which the container with the small parts can be swivelled and the degree, to which the drum is filled, are selected in such a way, that the small parts change their position relative to one another or in the container, during one swiveling process.

To avoid scratching of the freshly painted surfaces when rearranging the small parts from the container or from the conveyor belt to the support on which the paint is to be baked, this rearrangement can take place under water.

If the trays are electrical conductors, they can also be used as electrodes. If the trays have surfaces, which do not conduct electricity and cannot be wetted by the paint, they can also be passed through the rinsing device and the baking oven together with the coated small parts, provided that they are to retain their shape at the temperatures required for baking.

To prevent adhesion of the small parts to their support in the baking oven, this support must be provided with a surface, which is not wetted by the paint. For this purpose, it is also possible to change the position of the small parts and the support in the baking oven.

By means of a lateral guiding system, the conveyor belt is passed through the electrodip bath along a certain path. If the conveyor belt is made of stainless steel, corrosion products are prevented from reaching the paint bath.

During each passage of the conveyor belt through the electrodip bath, all metallic, exposed parts are coated electrophoretically. In order to reduce this, the conveyor belt can be provided with an electrically insulating layer, with the exception of the belt areas required for contacting the conveyor belt and for contacting the small parts. To produce this electrically insulating layer, the conveyor belt can be coated electrophoretically with the paint used and baked.

By using a plane-parallel arrangement of the conveyor belt and the counter-electrode, similar conditions are created over the entire width of the belt and the uniformity of the coating process is promoted. Furthermore, the size and volume of the electrodip bath can be reduced significantly since, with the plane-parallel arrangement, the distance between the bottom of the bath and the coating belt, which is required for circulation of the paint, functions at the same time as a safety distance between the electrodes.

Pursuant to a preferred embodiment, the counter-electrodes can be shifted for adaptation to the various types of small parts and for optimizing the coating process.

In the case of a continuous coating process, it is advantageous to rearrange the small parts. If the small parts are transferred from one conveyor belt to another by way of a slide, which is acted upon by a water film, mechanical damage to the surfaces of the small parts during transfer is prevented. This is particularly important for transfer from the conveyor belt of the electrophoretic dip coating to the conveyor belt which passes through the subsequent rinsing device and, optionally also through the baking oven.

A simple possibility for driving the conveyor belt while simultaneously guiding it laterally can be realized by means of drive chains on either side of the conveyor belt. The electrical contacting of segmented conveyor belts can be brought about by the use of metallic drive chains.

A synchronous operation of the drive rollers before immersion in and after removal from the electrodip bath makes possible the tension-free guidance of the conveyor. This is absolutely essential for diverting the belt by means of baffles, for example. The synchronization can be realized, for example, by means of a coupled, chain drive.

For the inventive method, a support is used, which is electrically conductive and has an electrically insulating layer, preferably of the same paint, on which the electrodip bath is based, in its baked form. Only the points of contact with the bulk goods as well as the sites for connection as electrode do not have this layer. The support can, for example, be abraded at these sites. However, pursuant to the invention, it is also possible to use an insulating support, for example, a completely coated support, and to bring the small parts lying on this support into contact with an electrode in the electrodip bath, for example, by placing a flexible electrode, on them. This deposition of the electrode or the contact can be made on a support, which is constructed as a conveyor belt or as a container, for example, as a tray.

In any case, irrespective of whether the support is or is not electrically conductive, and irrespective of whether it is a conveyor belt or container-shaped devices, the position of the small parts or bulk goods to be coated is changed in the electrodip bath, for example by intermittent jarring.

When electrically insulating supports are used, the electrodes, inserted from above, can be removed again at the latest before entry into the baking oven. The electrodes are totally or partially covered with an electrically insulating coating which is preferably the same lacquer (after baking), as is employed in the electrodip bath. The parts of the electrode that are required to contact the small parts and the bulk goods are not coated with the electrically insulating coating. After leaving the electrodip bath, the small parts can be moved to another conveyor belt or to other trays on which rinsing in the rinsing device and baking of the paint in a baking oven take place. It is advantageous if the conveyor belt or the other trays, which are used for the baking, have surfaces, which are not wetted by the paint in the baking oven. It is advantageous if the position of the small parts or the bulk goods on the other conveyor belt or the other trays is changed at least once in the baking oven.

The invention also relates to an apparatus for electrophoretic dip coating of small parts and bulk goods, which is suitable for implementing the inventive method. The apparatus comprises a bath container, an electrodip coating system, a rinsing device and a baking oven. It is characterized by the fact that a conveyor belt with a device for charging the small parts or bulk goods is arranged outside of the container, in such a way that it is moved into the container and moved out of it again at a variable angle, the conveyor belt being made of a material with high electrical conductivity and being provided with an electrically insulating layer, with the exception of the external surfaces of the belt necessary for the electrical contact and for contacting the small parts or the bulk goods to be coated, especially a baked layer of the paint used for coating in the electrodip bath, and that devices to change the transporting direction of the conveyor belt, to shift parts of the conveyor belt, to shift the small parts or the bulk goods on the conveyor belt or to jolt the conveyor belt are provided in the bath container.

Preferably, the conveyor belt is endless and, after leaving the electrodip bath, can be guided via a rinsing device for the coated small parts or the coated bulk goods, as well as devices for cleaning the conveyor belt in the form of a rinsing device and a cleaning brush for the external belt surface back to the electrodip bath.

The conveyor belt can be provided with a lateral guidance. Pursuant to a preferred embodiment, it is provided with cams for the small parts.

It is advantageous if the container for the electrodip bath contains one or more counter-electrodes encapsulated in electrodialysis pockets and arranged preferably in a parallel plane to the conveyor belt. Devices for shifting the position of the counter-electrodes may be contained in the electrodip bath.

Preferably, the conveyor belt is provided with drive chains at one or both sides. The conveyor belt is preferably moved by means of drive rollers, which are preferably synchronized to allow movement of the conveyer belt without slippage and without tensile stress.

Pursuant to a preferred embodiment, the conveyor belt, emerging from the container of the electrodip bath, is followed by another conveyor belt to accommodate the small parts or bulk goods, the additional conveyor belt serving to pass the coated small parts through a rinsing device.

This additional conveyor belt can also serve to introduce the coated small parts into the baking oven. However it is also possible to have the additional conveyer belt followed by another conveyor belt, which takes over the small parts from the conveyor belt, which is intended for the rinsing device, and passes through the baking oven.

In any case, the conveyor belt which passes through the balking oven, is preferably formed from a material or coated with a material, which is not wetted by the paint to be baked and is thermally stable at the baking temperatures required.

It is advantageous if the conveyor belt, which passes through the electric dip bath, as well as the conveyor belt are designed so that only small contact areas are possible with the small parts. For this purpose, the conveyor belt can be constructed, for example as a spiral wire belt with a round or triangular profile of the spirals. It is advantageous if the material of such spirals is stainless steel.

A slide, which is acted upon by a film of water, may be provided, for example, between the conveyor belt leaving the electrodip bath and the further conveyor belt for the rinsing device.

DESCRIPTION OF PREFERRED EMBODIMENT

In the following, an example of an apparatus for the continuous electrophoretic dip coating of small parts pursuant to the inventive method is described. It is understood that the example is given by way of illustration and not by way of limitation. The structure of the apparatus is shown in FIG. 1.

From a charging device 5, such as a vibrating conveyer, small parts or bulk goods 6, which are to be coated, are charged onto the conveyor belt 4 in a single layer. This type of charging with a vibrating conveyer is particularly recommended for thin and flat small parts, such as washers.

In the case of small parts with a cylindrical cross-section, which can roll off easily, it is more suitable to charge the parts onto a conveyor belt with cams, which prevent the small parts rolling off the conveyor belt, or onto a conveyor belt with a profile that prevents rolling off. A pusher, which is not shown in FIG. 1 and the height above the conveyor belt of which is adjustable, is located behind the charging device. With this pusher, a single layer of products can be guaranteed.

The conveyor belt 4 dips into the coating bath 7 at an angle that is less than 15 degrees. Sliding of the small parts or bulk goods can generally be prevented by such a small immersion angle.

Figure 2:
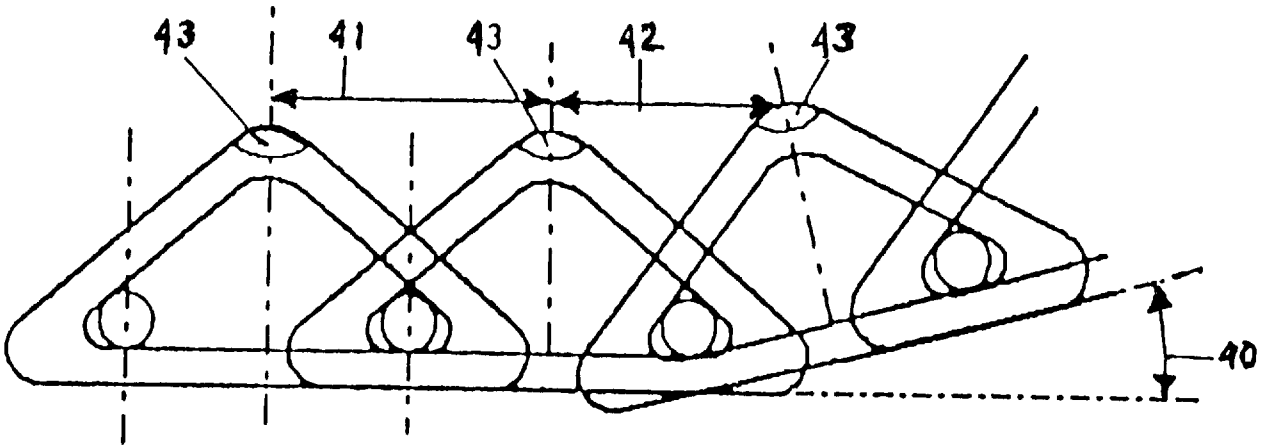
FIG. 2 is a schematic showing of a diversion of the conveyor belt to permit coating of uncoated contact points between the small parts and the conveyor belt.

By diverting the conveyor belt via a baffle, which is not shown in FIG. 1, the position of the small parts on the conveyor belt is changed. The original contact points between the small parts and the conveyor belt are exposed and can be coated. A change in the contact points between the small parts and the conveyor belt already takes place by diversion of the conveyor belt in the electrodip bath, provided that the profile of the conveyer belt is suitable. Such a possibility is shown in FIG. 2 With a diversion 40 of 15 degrees, the distance 41 or 42 between adjacent contact points 43 changes by 25% in this example.

When the conveyor belt 4 emerges from the bath liquid 7, the conveyor belt 4 and the small parts and bulk goods located on it are freed from excess paint by being rinsed with rinse water 10 from the rinsing device 2 in a first stage. Subsequent to this rinsing process, the small parts and bulk goods are transferred to another conveyor belt 12, which passes through the rinsing device 2. Before the small parts and bulk goods are transferred to a conveyor belt 13, which passes through a drying and baking oven 3, water drops adhering to the products can be removed by a blower, which is not shown in FIG. 1.

Figure 3:
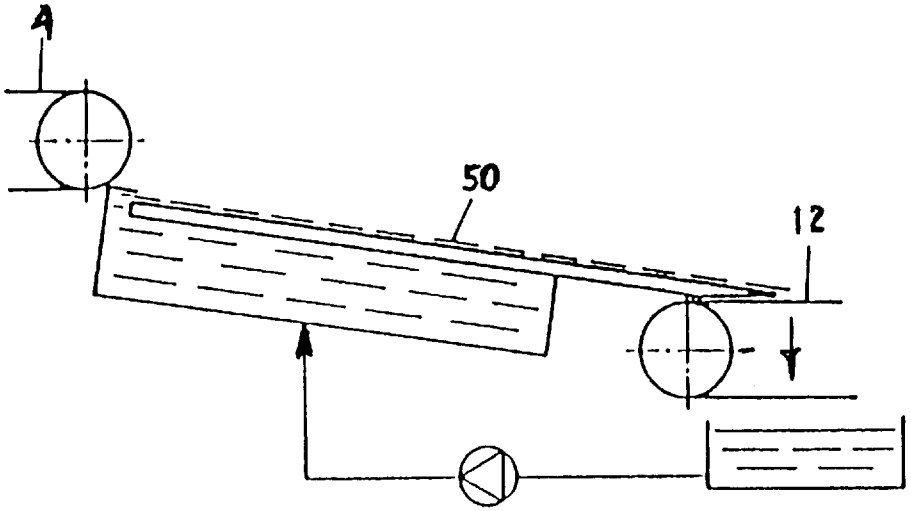
FIG. 3 is a schematic showing of a slide for transferring small parts between two conveyor belts.

Both the pre-rinse 10 of the small parts on the conveyor belt 4 after emerging from of the electrodip coating bath 7 and the rinse on the conveyor belt 12 in the rinsing device 2 take place simultaneously from below and above. The transfer of the small parts from the conveyor belt 4 to the conveyor belt 12 takes place, as shown in FIG. 3, via a slide, which is acted upon by a film of water 50 or, as in FIG. 1, via a slide 17, in which the small parts are rinsed from above and below at the same time. If needed, the transfer from the conveyor belt 12 to the conveyor belt 13 can also take place via such a slide.

The conveyor belt 4 is passed through a basin 14 with rinse water 15, in which the paint adhering to this conveyor belt is redissolved. Paint is removed from the metal contact surfaces of the conveyor belt with a cleaning brush 16 either as it is immersed in, as shown in FIG. 1, or as it emerges from or while it passes through the rinsing basin. The cleaning brush 16 is rinsed with rinse water from the rinsing device 35.

The rinse water 15 and the electrodip paint 7 are supplied to an ultrafiltration device via a filter 36 and a heat exchanger 37. The retained material 9 with the entrained paint is returned to the dip basin 1 for the cataphoretic dip coating process. The permeate 28 from ultrafiltration is supplied to the circulating rinsing device 2. From the rinsing device 2, the rinse water returns to ultrafiltration system 11. The rinse water 15 in the rinse basin 14 can be drained via the drain line 8. According to the instructions of the paint manufacturer, the pumps 21 and 22 ensure the circulation of the paint 7. These pumps 21 and 22 are designed so that the necessary motion of the bath can be achieved with one pump alone. Since sedimentation of the paint particles occurs already after very short shut-down times, a second pump is installed to ensure that the bath is kept in motion.

The basin 14 is component of a container 23, which is saturated with solvent vapor and in which the conveyor belt 4 is returned to the charging device 5. Returning the conveyor belt in this saturated solvent vapor prevents any drying out of the paint residues, which could not be removed from the conveyor belt by the cleaning brush 16 or in the rinse basin 14.

The conveyor belt 4 is grounded via the sliding contact 19. The counter-electrode 18—or the anode in the case of cataphoretic dip coating—can be shifted via the rail 20.

The anode is preferably located near where the conveyor belt 4 emerges from the paint liquid 7 in the dip bath 1 since the lowest current peaks are then obtained during immersion. In another preferred position, which is not shown in FIG. 1, the counter-electrode 18 is disposed below the conveyor belt 4 and parallel to the conveyor belt 4. The counter-electrode 18 is part of an encapsulated electrodialysis cell. Via the lines 25 and 26, the electrolyte of the encapsulated counter-electrode 18 is exchanged and regenerated. Via the electrical supply line 24, the desired voltage is supplied to the counter-electrode.

By synchronous operation of the drive rollers 29, 30, the coating belt 4 can be transported without the belt tension, which is normally necessary. This enables the belt to sag and the direction of the belt to be changed.

The material entrained from the paint bath 7, which cannot be recycled, is replaced in the refilling station 31 by make-up material 32 on the one hand and completely deionized water 33 on the other, via the level indicator 34.

Figure 4:
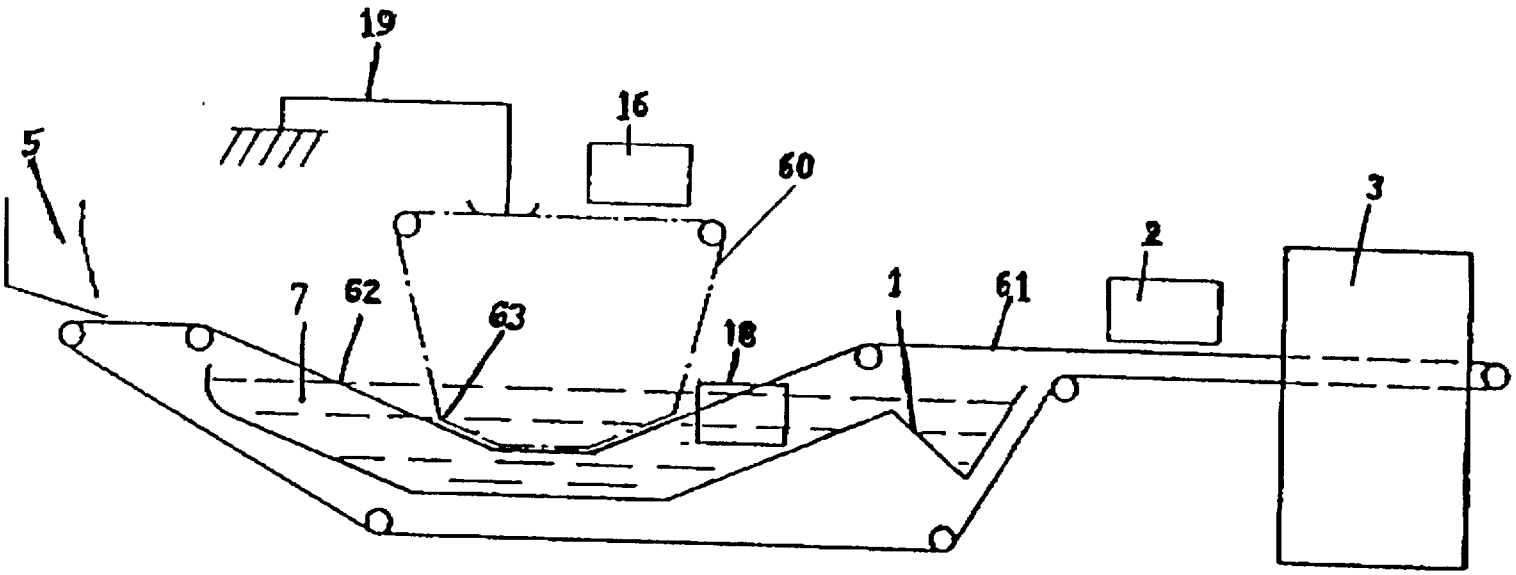
FIG. 4 is a schematic showing of another embodiment, particularly useful for small parts.

For certain product ranges of small parts, the use of a modification of the method, as shown in FIG. 4, may be advantageous. By separating the coating belt functions, contacting in the paint bath 7 by an electrically conducting belt 60 and conveying the products by a belt (61), the transport of small parts to be coated can be achieved using a single belt, without transfer stations. In addition, the dip segment between the immersion and contacting positions 62, 63 can serve as a currentless wetting zone.

I claim:

1. A method for electrophoretic dip coating of items having an electrically conducting surface, which comprises:

(a) placing the items to be coated in a single layer onto (i) an electrically conducting support which is in the form of a single conveyor belt which is connected to an electrode and is provided with an electrically nonconducting surface, except where the support is connected to the electrode and where the support is contacted by the item to be coated, or (ii) an electrically nonconducting support in the form of a simple conveyor belt, in which case each of the items to be coated is connected from above to an electrode provided with an electrically insulating coating except where it is connected to the item to be coated;

(b) immersing the support and the items to be coated into an aqueous electrodip bath and electrodepositing a surface coating on the items, there being a first surface contact location between the items to be coated and a second surface contact location between the items and the support:

(c) at least once during said immersion changing the surface contact locations between the items to be coated themselves and the surface contact locations between the items to be coated and the support by (1) changing the direction of movement of the conveyor belt in the electrodip bath, (2) by passing the conveyor belt over stationary or adjustable baffles, (3) by shifting parts of a segmented conveyor belt relative to one another, or (4) by jolting the conveyor belt, and in the case of a nonconducting support (a)(ii) the changing of surface contact locations further includes changing the surface contact locations between the items to be coated and the corresponding electrode connection;

(d) removing the coated items from the bath, and in the case of a nonconducting support removing the electrode connection from the items before or after rinsing;

(e) rinsing the coated items; and (f) baking the coated and rinsed items.

2. A method pursuant to claim 1 wherein change of the contacting surfaces is effected by change in direction of movement of the conveyor belt in the electrodip bath.

3. The method of claim 1 wherein (e) rinsing of the coated items is conducted by transferring to another conveyor belt and (f) baking of the coated items is conducted in a baking oven.

4. A method according to claim 3 wherein the surface of the conveyor belt is not wetted by paint in the baking step (f).

5. A method according to claim 3 wherein the position of the items on the conveyor belt is changed at least once during the baking step (f).

6. The method of claim 1 wherein the conveyor belt is moved at constant speed.

7. The method of claim 1 wherein the entry and exit angles of the conveyor belt into and from the electrodip bath can be varied.

8. The method of claim 1 wherein the conveyor belt is grounded.

* * * * *

UNITED STATES PATENT AND TRADEMARK OFFICE

CERTIFICATE OF CORRECTION

PATENT NO. : 5,810,987
DATED : September 22, 1998
INVENTOR(S) : Christian Opitz

It is certified that error appears in the above-identified patent and that said Letters Patent is hereby corrected as shown below:

Column 8, line 61, claim 1, change "simple" to --single--;

Signed and Sealed this

Twenty-fourth Day of October, 2000

*Attest:*

*Attesting Officer*

Q. TODD DICKINSON

*Director of Patents and Trademarks*